US005815587A

United States Patent [19]

Goller

[11] Patent Number: 5,815,587

[45] Date of Patent: Sep. 29, 1998

[54] LOUDSPEAKER WITH SHORT CIRCUIT RINGS AT THE VOICE COIL

[75] Inventor: Lars Goller, Herning, Denmark

[73] Assignee: Scan-Speak A/S, Videbaek, Denmark

[21] Appl. No.: 843,964

[22] Filed: Apr. 17, 1997

Related U.S. Application Data

[63] Continuation of Ser. No. 545,739, filed as PCT/DK94/00186 May 10, 1994, published as WO94/27413 Nov. 24, 1994.

[30] Foreign Application Priority Data

May 10, 1993 [DK] Denmark ..... 9549/93

[51] Int. Cl.[6] ..... H04R 25/00

[52] U.S. Cl. ..... 381/199; 381/194

[58] Field of Search ..... 381/192, 194, 381/195, 197, 199, 201

[56] References Cited

U.S. PATENT DOCUMENTS 5,151,943 9/1992 Van Gelder ..... 381/199

FOREIGN PATENT DOCUMENTS 0072797 3/1990 Japan ..... 381/199

0131100 5/1990 Japan ..... 381/199

9105447 4/1991 WIPO ..... 381/199

*Primary Examiner*—Huyen Le

*Attorney, Agent, or Firm*—Sixbey, Friedman, Leedom & Ferguson; David S. Safran

[57] ABSTRACT

The invention is a loudspeaker. The loudspeaker includes a driver diaphragm having a voice coil and an associated magnet system including an annular air gap within which the voice coil locates, the voice coil being longer than the axial extension of the annular air gap, the magnet system including a central pole piece, the voice coil and central pole piece having a frontal end towards said driver diaphragm and a rearward end away from said driver diaphragm, the magnet system further comprising a cylinder arrangement, of a material and of a wall thickness sufficient to provide a conductivity suitable to act as a short circuit ring carrying compensating induction currents, the cylinder arrangement comprising a root part at a root area of the pole piece and an inner pole ring part rearward of the annular gap, the root part being located outside the rearward end of the voice coil when the voice card assumes a position of rest, and further comprising an outer pole ring part located forward of the annular gap, the inner pole ring part and the outer pole ring part both being shorter than half a length of the voice coil.

21 Claims, 1 Drawing Sheet

LOUDSPEAKER WITH SHORT CIRCUIT RINGS AT THE VOICE COIL

This application is a Continuation of application Ser. No. 08/545,739, filed as PCT/DK94./00186 May 10, 1994, published as WO94/27413 Nov. 24, 1994.

BACKGROUND OF THE INVENTION

The present invention relates to a loudspeaker of conventional type, where voice coil of the loudspeaker diaphragm has an axial length larger than that of the annular air gap, in which the coil operates, and where there is mounted, at both sides of the air gap, a cylinder of electrically conducting material, also called a copper cylinder.

DESCRIPTION OF THE PRIOR ART

These cylinders are used in order to create surroundings for the coil which are, electrically, practically the same wherever the coil is located inside its range of oscillation; it is conventional, therefore, that the copper cylinders extend beyond the opposed ends of the coil, inwardly around the central magnet core and outwardly in the air outside the central pole piece, respectively.

It is a main effect of this arrangement that the magnetic field will be stabilized against changes caused by the current in the voice coil, inasfar as the copper cylinder will act as a short circuit winding, which, by the inductive coupling with the voice coil, will generate an inversely directed magnetic flux that will relieve the modulating effect of the voice coil on the flux in the permanent magnetic field.

Another main effect is that the current or current changes in the voice coil is coupled to an impedance which is largely independent of the position of the coil, i.e. whether it is located way in over the central iron core, where the impedance would otherwise be high, or way out from this core, where the impedance would be low. The large movements of the coil are caused by the low frequencies in the reproduced signal, and the simultaneous reproduction of the high frequencies would otherwise be highly influenced by the coil being located in the iron or air filled area, respectively. When the said 'short circuit winding' is present all over the operation length of the coil, the coil will present the same impedance in all of its positions, because the influence from the surroundings will be widely neutralized by the presence of the short circuit winding.

It has been found that the copper cylinders should have a considerable wall thickness in order to be really operative. Previously, it was found advantageous to make the copper cylinders extend continually through the air gap, with a wall thickness so small that the air gap should be made only slightly broader, but the fact is that the electrical resistance in the copper cylinder will hereby be high enough to substantially weaken the desired compensation effect.

When the copper cylinders should thus be both long and thick-walled, the use of them will involve a noticeable price and weight increase, and besides the problem occurs that the voice coil has to be placed on a tube core, which projects rearwardly rather far from the diaphragm, because the latter cannot be displaced inwardly any further than to the outer end of the copper cylinder, this being permanently projecting as far as corresponding to the outer maximum amplitude of the voice coil. The associated considerable length of the tube core is a problem seen from a stability point of view.

It is known to use a root ring of copper about the inner end of the pole piece, but without the ring being supplemented by copper rings at the effective magnet gap, and without being further specified how the ring is located relative to the maximum amplitude of the voice coil. Correspondingly, from DK-C-148,050, it is known to use relatively short copper rings or cylinders at the respective outer and inner sides of the foremost, a central pole piece, but without this being related to an additional ring of copper at the root of the central magnet core for a different purpose.

The known loudspeaker of FIG. 1 has a magnet system comprising a ring magnet 2 with a rear/lower pole plate 4, from the center of which a pole piece 6 projects forwardly/upwardly, and with a foremost/upper pole plate 8 made with a central hole 10, inside which, and flush with the pole plate 8, there is mounted an inner pole plate 12 on the outer end of the central pole piece 6. In the annular gap 14 between the pole plates 8 and 12 is located a voice coil 16, mounted on a cylindrical carrier core 18 connected with an outer loudspeaker diaphragm 20, which is held by a carrier chassis (not shown) in such a manner that the coil tube 18,16 is guided to carry out purely axial oscillations in the air gap 14.

In its position of rest the voice coil 16 is located so as to project equally to both sides of the plate portions 8 and 12. The pole piece 6 is surrounded by a cylinder 22 of copper, and a similar cylinder 24 is mounted so as to project forwardly/upwardly form the central pole piece 12. Therefrom, both of the copper cylinders 22 and 24 project beyond the ends of the voice coil 16, such that during operation they will steadily be located inside the oscillation area of the voice coil.

SUMMARY OF THE INVENTION

With the present invention it has been found that it is not necessary for the copper cylinder to extend completely over the working length of the voice coil in order to effectively fulfill its purpose. It is sufficient that a short cylinder piece is mounted about the root of the central part of the magnetic system, whereby the associated inductive coupling with the voice coil will ensure that the coil will represent the same impedance whether, at a given moment, it is moving towards or away from the iron filled area at the central core portion of the magnet system. However, it will still be required to stabilize the induction of the voice coil, such that the induction will be substantially the same, no matter where the voice coil is located relative to the air gap, and to this end it has been found that it is fully sufficient to mount a compact copper ring immediately at either side of the air gap, i.e. copper rings which, axially, are substantially shorter than the axial dimension of the voice coil, while being suitably thick in order not to substantially limit the current induced in these rings. Hereby it becomes sufficient that the rings occur as relatively short units, and the totality of three ring parts will thus be able to show a combined axial length considerably shorter than the operational length of the voice coil. This will condition a both lighter and cheaper design of the loudspeakers.

BRIEF DESCRIPTION OF THE DRAWING

In the following the invention is described in more detail with reference to the drawing, in which:

FIG. 1 is a sectional view of the coil and magnet system of a known loudspeaker type, while

DESCRIPTION OF THE PREFERRED EMBODIMENTS

Figure 1:
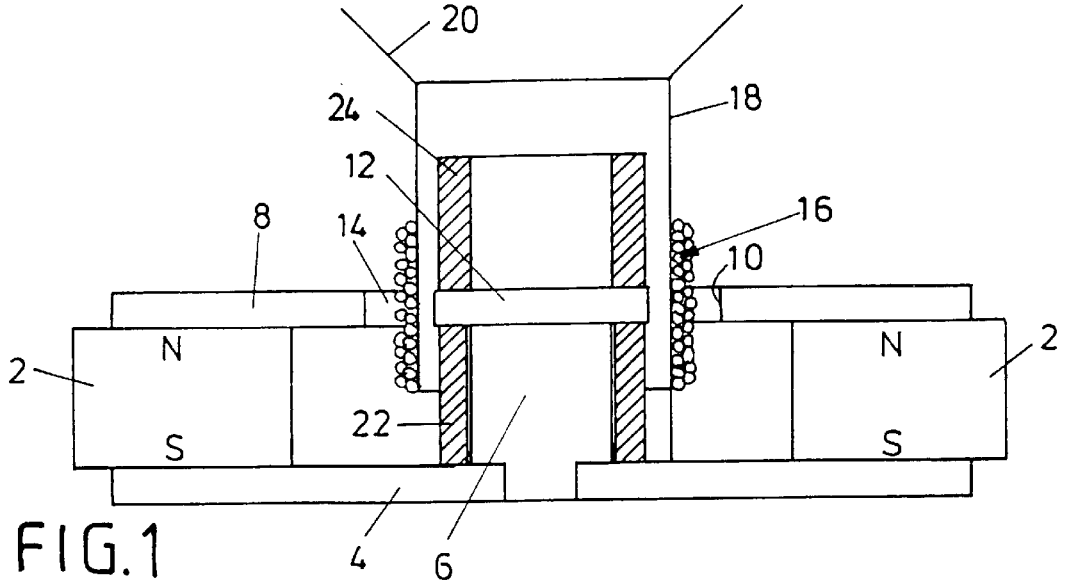
FIG. 1 PRIOR ART
Figure 2:
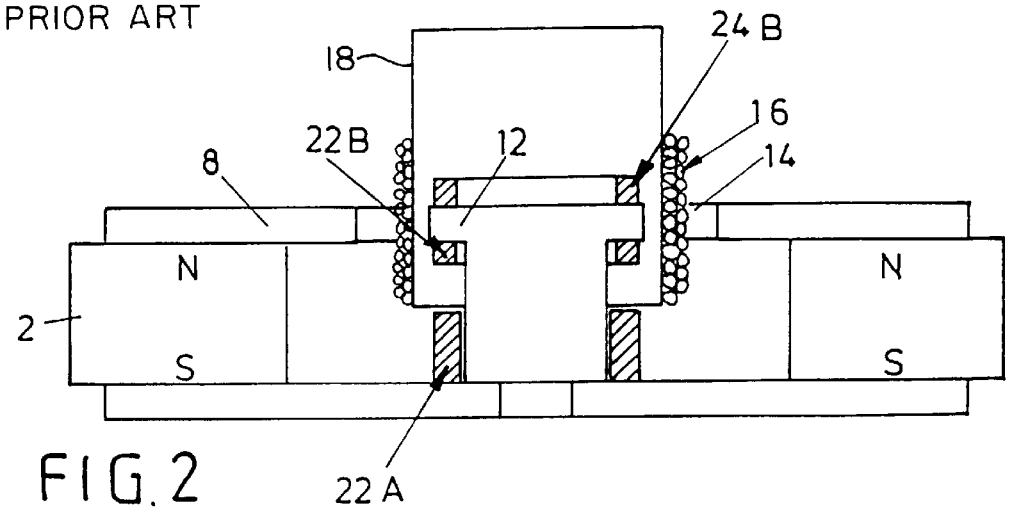
FIG. 2 is a corresponding view of a loudspeaker according to the invention.

In connection with the invention as illustrated in FIG. 2, it has been recognized that the total length of the copper cylinders 22 and 24 can be reduced essentially, because it is sufficient to make use of a shortened root cylinder 22A extending from the pole plate 4 forwardly/upwardly approximately to the inner/lower end of the voice coil 16, and two axially short copper rings 22B and 24B mounted at the respective opposite sides of the central pole plate 12. When comparing FIGS. 1 and 2 it will be seen that it is hereby possible to use a noticeably reduced amount of copper, whereby the loudspeaker can be lighter and less expensive.

Moreover, it will be possible to shorten the core tube 18 of the voice coil, since the diaphragm 20 can now be moved closer towards the magnet system, and such a shortening involves great advantages in several respects.

It has been found that with the use of a system according to FIG. 2 the advantages obtained are obtained when only the copper rings are made thick enough, i.e. with a thickness of several millimetres, to carry the actual counter electromotoric forces without offering any noticeable resistance. The root cylinder 22A should not extend into the voice coil in the rest position thereof, as the only task of this cylinder is to compensate for the varying iron filling of the coil. The optimal length of the cylinder can be experimentally determined, and it has been found that the most correct compensation is obtained when the cylinder is located outside the voice coil, even in the maximum inwardly displaced position thereof. Then a variation of the degree of coupling between the coil and the cylinder will occur during the entire course of oscillation, as a pure function of the variation of the iron filling of the coil, with efficient compensation being achieved.

When the coil supercedes its operative maximum displacement, the phenomenon of 'clipping' occurs, referring to the top of the signal, being compressed, whereby the associated curve of the signal approaches a rectangular shape. As well known, this produces an increased content of overtones relative to the base tone, meaning distortion.

The invention provides for an improvement even of this phenomenon, in that the voice coil, when oscillating excessively, will surround but a small amount of copper in the system 22*b*, 24*b*, whereby the effect of the copper with respect to a minimising of the induction of the voice coil will be reduced. Thereby the impedance of the coil will increase at high frequencies, i.e. the formation of the distorting overtones will be counteracted such that the associated distortion will be reduced considerably.

Thus, it will be appreciated that the "shortage of copper" according to the invention relative to the prior art does not imply only a saving, but even a qualitative improvement in the sound reproduction of the loudspeaker.

Figure 3:
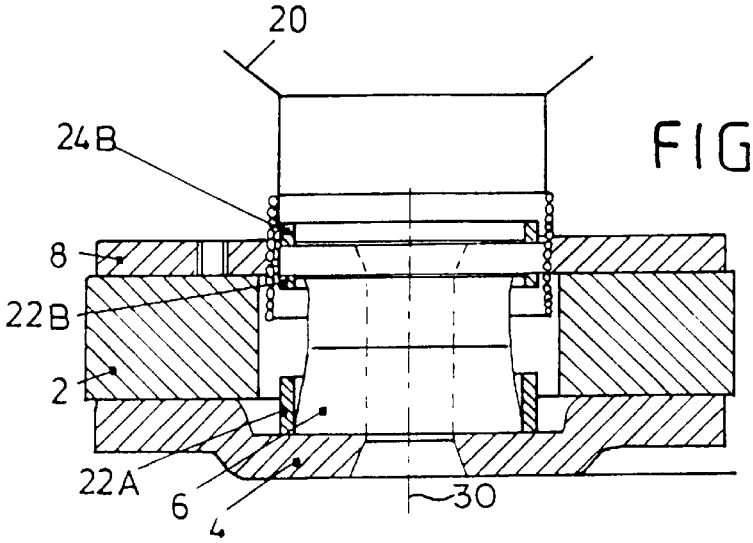
FIG. 3 is a similar and authentic view thereof.

FIG. 3 is a sectional view of a loudspeakers used for measurements in connection with the invention, i.e. this figure is authentic as far as the dimension relations are concerned. It will be noted that there is a substantial axial distance measured along axis 30 between the root ring 22A and the inner end of the voice coil and that the ring 22B is slightly thinner than the ring 24B; this reduced thickness is owing to the fact that the root ring 22A to some degree contributes to the function of the ring 22B, which contribution is reduced when the coil moves outwardly, such that the outer ring 24B ideally should be somewhat thicker than the ring 22B. In this example the thickness of the ring 24B is only about ⅙ of the length of the voice coil. None of the rings 22B and 24B should extend beyond the voice coil in the neutral position thereof, as this would compromise the reduction of the clipping distortion mentioned above. The length of the voice coil of this loudspeaker is 18 mm. It has been found sufficient for the root ring 22A to have a length of 8 mm, this being less than half of the distance between the inner pole ring 22B and the outer/lower end of the root ring. The total length of the copper rings is about 13 mm, while in a corresponding system according to FIG. 1, it would be some 40 mm.

The axial length along axis 30 of the part 22B may be smaller than the axial length along the axis 30 of the part 24B.

For the invention it is not decisive whether the copper rings are placed inside or around the voice coil, although the efficiency is higher when they are placed inside the coil. Many parameters will influence the exact dimensioning of the parts for obtaining the desired ideal result, and for every new loudspeaker design it will normally be required to carry out a series of test with parts of different dimensions until both the general impedance stabilization and the minimized clipping distortion is established. Thereafter, the solution as found may be used as a standard for all loudspeakers of that particular design.

I claim:

1. A loudspeaker comprising a driver diaphragm having a voice coil and an associated magnet system including an annular air gap within which the voice coil locates, the voice coil being longer than the axial extension of the annular air gap, the magnet system including a central pole piece, the voice coil and central pole piece having a frontal end towards said driver diaphragm and a rearward end away from said driver diaphragm, the magnet system further comprising a cylinder arrangement, of a material and of a wall thickness sufficient to provide a conductivity suitable to act as a short circuit ring carrying compensating induction currents, the cylinder arrangement comprising a root part at a root area of the pole piece and an inner pole ring part rearward of the annular gap, the root part being located outside the rearward end of the voice coil when the voice coil assumes a position of rest, and further comprising an outer pole ring part located forward of the annular gap, the inner pole ring part and the outer pole ring part both being shorter than half a length of the voice coil.

2. A loudspeaker according to claim 1 in which an axial dimension of the inner pole ring part is smaller than that of the outer pole ring part.

3. A loudspeaker according to claim 2, in which said material is copper.

4. A loudspeaker according to claim 3, in which the inner and outer pole ring parts are placed inside the voice coil.

5. A loudspeaker according to claim 2, in which the inner and outer pole ring parts are placed inside the voice coil.

6. A loudspeaker according to claim 1 in which the axial dimension of the root part is smaller than a distance between the root part and the inner pole ring part.

7. A loudspeaker according to claim 6, in which said material is copper.

8. A loudspeaker according to claim 7, in which the inner and outer pole ring parts are placed inside the voice coil.

9. A loudspeaker according to claim 6, in which the inner and outer pole ring parts are placed inside the voice coil.

10. A loudspeaker according to claim 1, in which an axial dimension of the root part is less than half of a length comprising a sum of the axial dimension and a separation between the root part and the inner pole piece part.

11. A loudspeaker according to claim 10, in which said material is copper.

12. A loudspeaker according to claim 11, in which the inner and outer pole ring parts are placed inside the voice coil.

13. A loudspeaker according to claim 10, in which the inner and outer pole ring parts are placed inside the voice coil.

14. A loudspeaker according to claim 1, in which said material is copper.

15. A loudspeaker according to claim 14, in which the inner and outer pole ring parts are placed inside the voice coil.

16. A loudspeaker according to claim 1, in which the inner and outer pole ring parts are placed inside the voice coil.

17. A loudspeaker according to claim 16, in which the root part is located outside the rearward end of the voice coil even when the voice coil is in an operatively maximum rearward displaced position thereof.

18. A loudspeaker according to claim 1, in which an axial dimension of the root part exceeds that of either pole ring part.

19. A loudspeaker according to claim 1, in which the root part is located outside the rearward end of the voice coil even when the voice coil is in an operatively maximum rearward displaced position thereof.

20. A loudspeaker according to claim 16, in which an axial dimension of the root part exceeds that of either pole ring part.

21. A loudspeaker according to claim 18, in which an axial dimension of the root part exceeds that of either pole ring part.

* * * * *